United States Patent [19]

Bascom

[11] 3,999,014

[45] Dec. 21, 1976

[54] PADDED FURNITURE FOR REVERENT ATMOSPHERE

[76] Inventor: Albert W. Bascom, Box 585, Keene, Tex. 76059

[22] Filed: July 22, 1974

[21] Appl. No.: 490,808

[52] U.S. Cl. ..... 179/1 AT; 297/191

[51] Int. Cl.[2] ..... H04R 27/00

[58] Field of Search ..... 179/1 AT, 1 E, 1 GA; 297/191, 186, 384, 452; 181/33 G, 33 GB, 151

[56] References Cited

UNITED STATES PATENTS

| | | | |
|---|---|---|---|
| 2,094,681 | 10/1937 | Sears | 179/1 AT |
| 2,208,068 | 7/1940 | Blaski | 179/1 AT |
| 2,982,342 | 5/1961 | Liljengren | 297/DIG. 1 |
| 3,538,254 | 11/1970 | Ancha | 179/1 AT |
| 3,669,498 | 6/1972 | Meyers et al. | 297/452 |

FOREIGN PATENTS OR APPLICATIONS

| | | | |
|---|---|---|---|
| 4,421,697 | 9/1969 | Japan | 179/1 GA |

*Primary Examiner*—Kathleen H. Claffy
*Assistant Examiner*—Joseph A. Popek
*Attorney, Agent, or Firm*—James C. Fails

[57] ABSTRACT

An improvement in furniture, such as a church pew, for a reverent atmosphere characterized by resilient padding on both front and back of the back rest and a fabric cover over the resilient padding. Preferably, individual speakers are included in the respective pews and covered with fabric for low overall noise level but improved ease of hearing and reverence. In church pews, it is preferred that the back rests of the pews also have a fabric covered book rack for reduced noise. Also disclosed are preferred structural embodiments in terms of location and structure for housing the speakers.

4 Claims, 6 Drawing Figures

PADDED FURNITURE FOR REVERENT ATMOSPHERE

BACKGROUND OF THE INVENTION

1. Field of the Invention

This invention relates to furniture for use in a reverent atmosphere. More particularly, it relates to the type of furniture generically referred to as pews, for sanctuaries and the like, having seat and back rest carried by leg supports.

2. Description of the Prior Art

The prior art has seen a relatively large number of pews for use in reverent atmospheres, as in sanctuaries, funeral homes, churches and the like. In general, the pews, regardless of whether or not they included wall structure for defining a family area, were of two major types. In the first type individual seats were employed. This is advantageous for the adults since greater comfort can be achieved; but is disadvantageous from other points of view, such as expense and having room for small children to lie down. The other major type was of the elongate seat variety conventionally associated with the word "pew" and illustrated in FIG. 1, described later hereinafter. In the latter type of pews, there has been very little change. The leg supports may be incorporated into the ends of the pews or placed separately from the end structures; integral with or separate from the arm rests. It has been conventional to employ a resilient padding and cover on the seat portion of the pews. Ordinarily, no padding is employed even on the front of the back rest. Insofar as I am aware, no pews have ever employed resilient padding and cover on the back thereof. Architects and engineers with whom I initially discussed designing furniture for use in sanctuaries or the like reported that fabric on the back of the pews would tend to change dimensions with changes in temperature and humidity, would sag and would become unsightly. Moveover, they said any fabric that would be emplaced on the back of the pews would be quickly worn and unsightly at the bottom and top because of rubbing of shoes and the like against the fabric adjacent and against the bottom of the back rest of the pew and hands and the like at the top of the back rest. Early trials bore out their predictions.

Moreover, a severe problem encountered in sanctuaries or the like desiring a reverent atmosphere and yet adequate hearing has been achieving a proper sound distribution. Heretofore, the structural design and layout included a plurality of stragetically spaced speakers around the periphery or in the ceiling of the sanctuary. These speakers were connected to a central amplifier that was connected with a microphone. Such systems had an uncomfortable and irreverent loudness in a portion of the sanctuary adjacent the speakers but too low a sound level at portions remote from these speakers. In addition, the delay of sound travel from distant speakers frequently caused interference patterns in the acoustics, particularly because of the loudness of the speakers. The problem is worsened by the conventional high noise level; for example, by returning hard back hymnals to hard wooden book racks.

The book racks also have posed a problem with cleaning small trash paper, like gun wrappers, debris and the like, therefrom. Such cleaning has been tedious and time-consuming or has required a powerful vacuum cleaner with a long hose or the like.

After many years of work in the field, I have determined that a good system of furniture for use in a reverent atmosphere should have the following features not heretofore provided.

1. The plurality of pews should have fabric covering on both front and back to lower the noise level and provide a reverent feeling in the sanctuary.

2. The furniture should have a means to absorb energy and lessen wear on the fabric, particularly on the back of the pews.

3. The furniture should have means to compensate for change in dimension or changes in temperature and humidity so as to prevent sagging of any fabric employed.

4. The furniture should incorporate means for obtaining substantially uniform acoustics throughout the sanctuary for easier hearing, yet reduce the overall noise level; without the uncomfortable loudness near large speakers and the diffused, low level of sound (with or without interference patterns) in areas remote from the speakers.

5. In churches, the furniture should have relatively noiseless racks for returning song books and the like for the low noise level and reverent feeling.

6. When the furniture has the features of feature (5), it should provide means facilitating cleaning out of the book racks without requiring long vacuum hoses and the like.

Insofar as I am aware, the prior art has not been satisfactory in providing one or more of the foregoing features. Specifically, the prior art has not be satisfactory in providing furniture that affords all of the features delineated hereinbefore.

SUMMARY OF THE INVENTION

Accordingly, it is an object of this invention to provide furniture for use in reverent atmospheres, such as sanctuaries or the like, providing one or more of the features delineated hereinbefore and not heretofore provided.

It is a specific object of this invention to provide furniture, such as pews, for use in sanctuaries or the like, providing all of the features delineated hereinbefore and not provided by the prior art.

These and other objects will become more clearly apparent from the following descriptive matter, particularly when taken in conjunction with the appended drawings.

In accordance with this invention, furniture is provided for use in reverent atmospheres, as for sanctuaries or the like. The furniture has the conventional seat and back rest carried by leg supports and is characterized by an improvement comprising a resilient padding on both the front and back of the back rest and a fabric cover over the resilient padding. The resilient padding provides comfort on the front of the back rest and so is disposed over the majority of the surface. The resilient padding is disposed on at least the top and bottom of the back rest for compensating for changes in dimension with changes in temperature and humidity as the weather changes and preventing sagging of the fabric and for absorbing energy and lessening wear from people rubbing their shoes at the bottom and from rubbing and leaning on the fabric at the top of the back rest.

Preferably for better acoustic and more reverent atmosphere, individual speakers are attached to the pews and covered with fabric for providing a low, yet clear and coherent sound, such that no individual is more than about four feet from a speaker. The sound system also preferably includes plug-in jacks for facilitating hearing by way of headphones for those suffering from partial loss of hearing.

Preferably, also, covered book racks are employed on the back of pews in churches or the like to lower the noise of returning hymnals or the like to the book racks. Covered book racks still more preferably have a discontinuity, or aperture, intermediate their ends to facilitate cleaning by merely sweeping small trash through the aperture, without requiring long vacuum hoses and the like to vacuum out each individual book rack.

DESCRIPTION OF PREFERRED EMBODIMENTS

Figure 1:
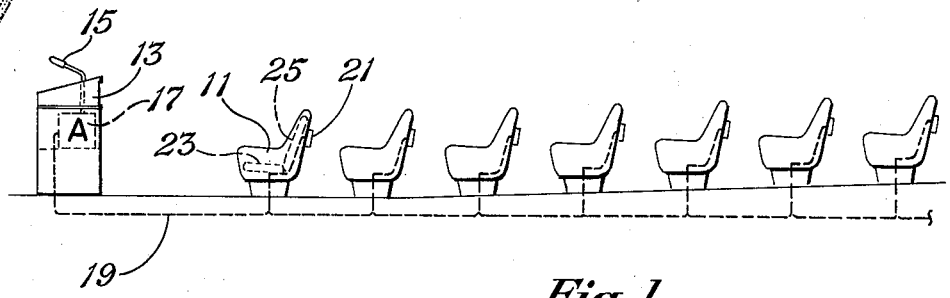
FIG. 1 is a schematic side elevational view of a sanctuary having the pews disposed therewithin in accordance with another embodiment of this invention.

Referring to FIG. 1, the furniture for the reverent atmosphere, such as a sanctuary or the like, includes a plurality of pews 11 that are disposed adjacent each other and arranged in respective front to back relationship such that the occupants face toward a podium, or lectern, 13. The podium 13 may be occupied by a pastor, singer, or the like. At the podium, there is a microphone 15 that is connected with an amplifier (A) 17. The amplifier 17 amplifies the signals emitted by the microphone 15 responsive to the oral, or acoustic, stimulation. The amplifier 17 is electrically connected via conductors 19 with a plurality of respective speakers 21 connected with the pews so as to convert the signals from the amplifier 17 back into acoustic energy and provide a substantially uniform level of sound throughout the sanctuary. Moreover, the speakers 21 are so located that no person in the sanctuary is more than about five feet from the speakers so there need not be an uncomfortable loudness close to the speakers nor a difficulty hearable softness remote from the speakers as in conventional systems.

Moreover, to keep the noise level low and provide a feeling of reverence, the church pews 11 are designed in accordance with this invention as described hereinafter.

Figure 2:
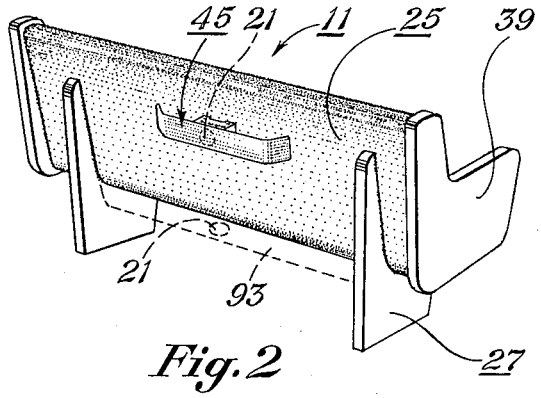
FIG. 2 is an isometric view of a church pew in accordance with one embodiment of this invention.

Referring to FIGS. 1 and 2, the pews 11 include the usual seat 23, back rest 25 and leg supports 27 carrying the seat and back rest 23 and 25.

Figure 2A:
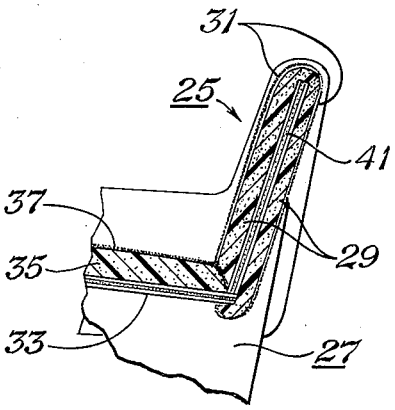
FIG. 2A is a partial cross sectional view of the back rest of the embodiment of FIG. 2.
Figure 5:
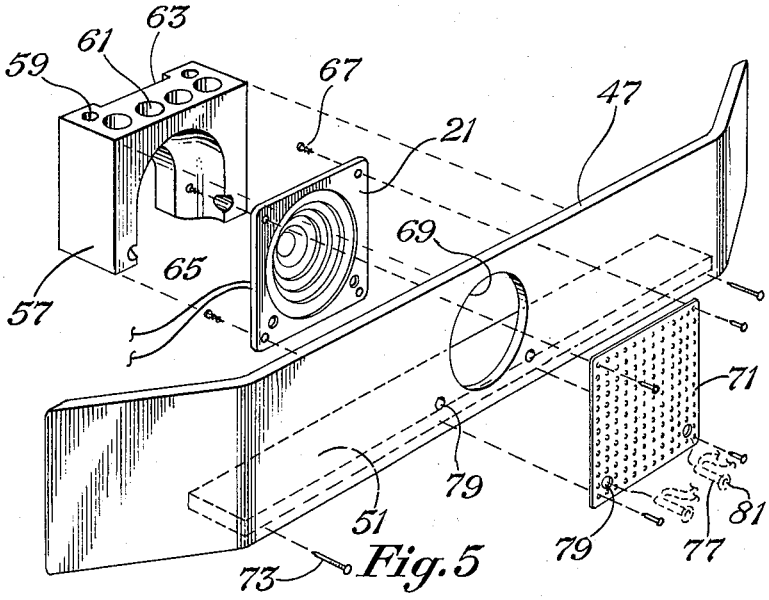
FIG. 5 is an exploded view of a speaker installation in accordance with an embodiment of this invention.

In addition, the pew 11 has the improvement comprising resilient padding 29, FIG. 2A, on both the front and back of the back rest, as well as on the seat; and a fabric cover 31 over the resilient padding 29.

The podium 13 may comprise any conventional podium, such as employed in church, funeral home or the like.

The microphone 15 is a conventional microphone for picking up speech, singing and the like from a distance of two to three feet. Such microphones are conventional. The amplifier 17 may comprise any of the amplifiers that have relatively linear amplification of frequencies in the audible range; for example, from about 50 to about 20,000 Hertz (cycles per second); so as to avoid distorting frequency patterns of talking, singing or the like. The amplifier 17 will amplify as necessary depending upon the matching of the microphone 15 and the respective speakers 21. For example, the amplification may be from as little as 10:1 to as great as 10,000:1. Ordinarily, only a single amplifer is adequate for an entire sanctuary. If it is desired to provide two levels of amplification; including a high level for those having a partial loss of hearing, more than one amplifier and sound channel may be employed. The conductors 19 included in a sound channel and connecting the amplifier 17 with the respective speakers 21, may comprise any of the conventional wiring, such as the small gauge wiring employed in conventional sound systems with respect to speakers being driven by an amplifier. Ordinarily, the conductor is encased in an insulating sheath, as of plastic or the like.

The speakers 21 may comprise any suitable speaker having the desired fidelity over the audible frequency range. Ordinarily, small diameter speakers having a diameter of from three to five inches are adequate and can be readily concealed by the fabric covering. Such speakers are economical and readily available.

The seat 23 may comprise any of the conventional seats, such as the wooden slab 33, FIG. 2A, with a removable cushion comprising resilient padding 35 and a fabric cover 37. If desired, the resilient padding and the fabric cover can be affixed to the wooden slab by conventional means.

The leg supports 27 may comprise any of the conventional type of leg supports. For example, the respective ends of the pews may comprise the leg supports, with or without an intermediate leg support. As illustrated, the ends 39, FIG. 2, are separate from the individual leg supports 27. Thus, ends 39 provide arm rests but not leg support. The ends 39 may house speakers; for example, speakers for the front row pews. Ordinarily, the leg supports will be simply wooden slabs that are precut to carry the seat and back rest of the pew 11 and are physically attached to the wooden slabs of the seat and back rest, as by screws and adhesive, like wood glue.

The back rest 25 comprises a central structural member, such as wooden slab 41, covered on both sides by the respective resilient padding 29 and fabric cover 31. If desired, the structural member may be other than a wooden slab.

The resilient padding 29 is disposed on the front of the back rest, similarly as on the seat, over the major portion thereof for comfort of the occupant. As illustrated, the resilient padding 29 is disposed over the entire front of the back rest 25. The resilient padding 29 is disposed over at least the top and bottom of the back of the back rest for compensating for change in dimension of the fabric cover 31 with changes in temperature and humidity, as brought about by weather changes. In addition, the resilient padding at at least the top and bottom of the back absorbs energy and lessens the wear from people contacting the fabric covering 31; for example, by contacting it with a shoe at the bottom of the pew. The resilient padding may comprise any of the padding materials conventionally employed; for example, foam rubber, polyurethane foam, polystyrene foam, or the like. It is imperative that the padding be resilient in order to be compressed a small amount by tightly pulling the cover such that it will compensate for the tendency of the cover to change in dimension; yet have sufficient resiliency to absorb the energy of contact with shoes and the like and prevent wear such as is normally experienced when a fabric is adjacent a hard surface, such as wood. As illustrated, the resilient padding 29 covers substantially the entire back of the back rest 25.

The fabric cover 31 is a fabric that is susceptible to changes in dimension, although small, with changes in temperature and humidity and susceptible to wear with contact with shoes and the like if against a hard surface, such as wood. In the installed position the fabric cover has a longitudinal stretch induced thereinto. Preferably, a stretch of at least ½ inch for the length of the pew is induced in order to help maintain a fine look to the fabric and to help compensate for the tendency to sag. The fabric cover may comprise any fabric having the desired texture, color and finish for the particular sanctuary or other place of reverent atmosphere in which it is installed. Preferably, the fabric cover 31 is permeable, rather than being a smooth impermeable plastic. Such permeability allows "breathing" for a greater sense of comfort. In addition, the fabric cover 31 should have sufficient tightness of weave to wear well. A particular type of fabric cover that is satisfactory is that referred to as gross point. In the gross point fabric, there are a multiplicity of outwardly protruding fibers that wear well and are particularly effective in absorbing acoustic energy to produce a low noise level and a hushed sense of reverence. The fabric may be of any of the conventional fabrics that have the foregoing properties; for example, Nylon, Orlon, polyester, acrylic-polyester or the natural fabrics, such as cotton, wool or the like; or any combination thereof.

Figure 3:
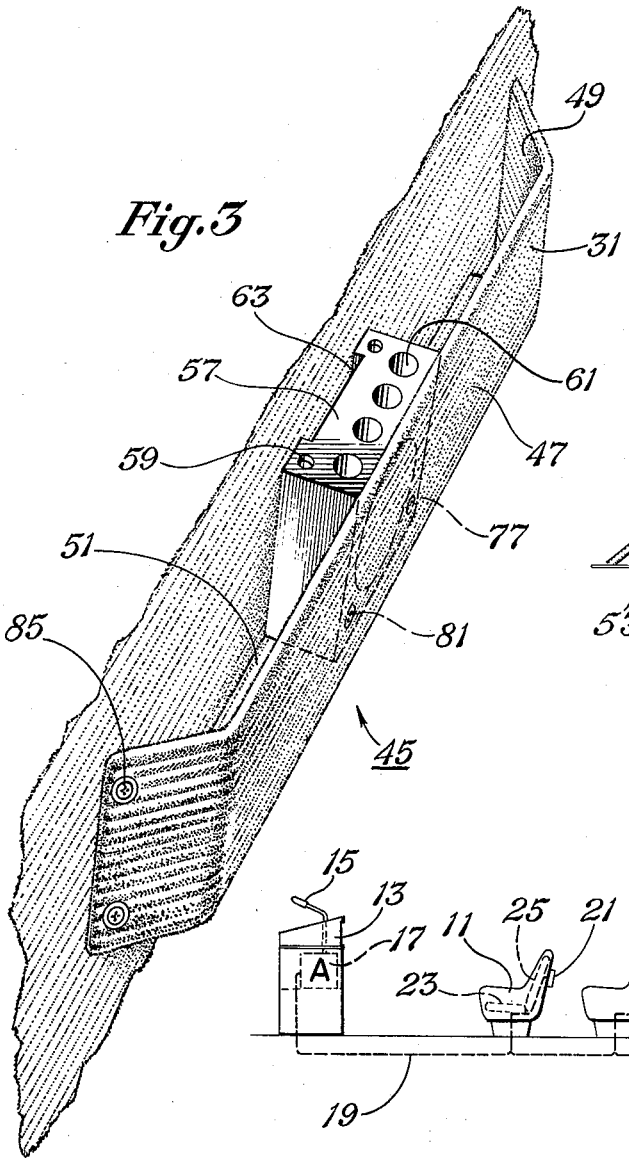
FIG. 3 is an isometric view of a padded book rack and speaker in accordance with the embodiment of FIG. 1.
Figure 4:
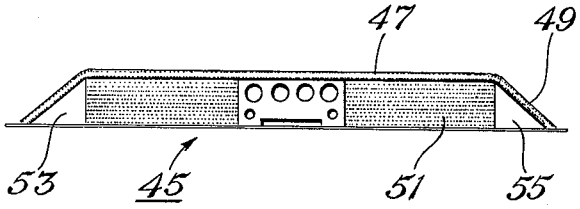
FIG. 4 is a top view of the book rack of FIG. 3.

As illustrated, each pew 11 has attached thereto at least one book rack 45. The book rack 45 has a rearwardly protruding side 47 that is covered both inside and outside with a fabric cover for reduced noise and reduced acoustic reflections and hence, an overall reduced noise level. The book rack 45 also has respective ends 49 that are covered both inside and outside with a fabric cover for reduced acoustic reflections and reduced noise level. The ends 49 may be formed separately or may be integrally connected with the side 47, as illustrated. The book rack 45 also has a bottom 51, FIGS. 3 and 4, that is covered by a fabric cover on at least its interior for reduced noise of returning hymnals and the like. As can be seen most clearly in FIG. 4, the bottom is discontinuous intermediate the ends 49 so as to define respective apertures 53 and 55. The apertures 53 and 55 facilitate sweeping out accumulated small trash, without requiring vacuuming out the covered book rack. If desired, a small amount of resilient padding may be emplaced intermediate the respective sides, ends and bottom and the fabric cover 31 thereover. Such a small amount of resilient padding reduces the wear, as described hereinbefore, as well as the noise level.

As indicated hereinbefore, each speaker 21 may be installed at any appropriate position and connected with the pew 11. In the embodiment illustrated in FIGS. 2–5, the speaker is installed in a central block 57 in the book rack 45. As illustrated, the block 57 has holes 59 and 61, as is conventional, for receiving pencils, communion cups and the like. The block 57 also has a recess 63 defining a pocket for receiving visitors slips and other such cards and the like. In addition, the block 57 contains a large recess 65 at its bottom with an arcuate, or arch-like, upper portion for receiving the speaker 21. The speaker 21 may be attached directly to the block or, as illustrated, attached to the side 47, as by screws 67. The side 47 has an aperture 69 cut thereinto to facilitate transmission of sound from the speaker 21 to the occupants of the pew behind. A perforate cover plate 71 is emplaced over the aperture 69 to reinforce the fabric cover 31 that will be emplaced thereover; yet conduct the sound therethrough. The plate 71, the side 47 and the bottom 51 may be joined together by any suitable means, as by nails 73, with or without glue. The fabric cover 31 may be emplaced over the respective bottom, ends and sides before being joined together or afterwards as desired to simplify fabrication and assembly.

As illustrated in dashed lines 77, suitable plug-in jacks may be employed if desired. The plug-in jacks are emplaced through suitable apertures 79 in the perforate plate 71, side 47 and block 57. Each of the respective plug-in jacks and the speakers have suitable conductors, or leads, for connecting them into the respective sound tracks. As illustrated, the plug-in jacks 81 are for electrical connection with a head set or the like (not shown). If desired, the acoustic tube type plug-in jets may be employed for use with the acoustic tube type head sets. As is well known, the acoustic tube types employ a trapped column of air with respect to a remote speaker to facilitate magnification of the sound waves that are conducted to the ear on a localized basis, rather than achieving generalized distribution, such as the speaker 21. On the other hand, the electrical jacks employ the electrical signals from the amplifier 17 to energize speakers in the headphones or the like. Ordinarily, the plug-in jacks will not be necessary on all of the pews but may be installed on those in a section reserved for those with a partial loss of hearing. Of course, the plug-in jacks may be employed on all of the pews to enable those with a partial loss of hearing to sit with the rest of their family, if desired.

In operation, the respective pews are assembled as described hereinbefore with the resilient padding over both the front and back of the back and fabric cover 31 installed thereover. The fabric cover may be fastened to the wooden slabs at the appropriate point by any conventional means, as by staples, with or without adhesive. Thereafter, a covered book rack is assembled as described hereinbefore and is installed on the back of the pew 11, as by screws 85, FIG. 3. Electrical conductors from the respective speakers and plug-in jacks if employed, are run along the wooden slab beneath the fabric and run down leg supports or the like out of sight. The main electrical conductors 19 will be hidden under carpet or the like and connect the amplifier 17 with the respective speakers 21. The amplifier 17 is electrically connected with the microphone 15. Thereafter, the microphone 15 may be employed as is conventional. Since a speaker is located in each hymnal holder, the sound reaches each individual occupant of the pew with as little interference patterns and as nearly uniform level of volume and clarity as is possible. Each occupant in the church can hear as well as if he were immediately in front of the podium. This system eliminates the uncertain acoustics normally encountered. Such normally encountered acoustics also interfere with the feeling of reverence.

Also, the problem of locating and properly mounting large speakers as in conventional systems is eliminated with no increase in cost. In fact, one system called the "Whisper Sound System" of Bascom Church Furniture Company in Keene, Tex. is often less costly than that paid in most churches for less effective speaker systems.

Whereas the speaker installed in the book rack has been described hereinbefore, a speaker may be installed in any appropriate location as desired. For example, in funeral homes or the like where no book racks are employed, the speaker 21 may be installed in an extension 93, shown in dashed lines at the bottom of the pew 11 in FIG. 2. When such an extension 93 is employed, it is preferably covered with resilient padding and the fabric cover 31 such that the fabric covers the speaker and hides it from view.

The wiring from the respective speakers and plug-in jacks is ordinarily run along the respective extensions and wooden slabs and under the fabric cover, or at least out of sight from the occupants of the respective pews, as described hereinbefore.

As can be seen from the foregoing, this invention achieves the objects delineated hereinbefore in providing features not heretofore provided by the prior art. Moreover, the invention employs readily available materials that are economical and can be easily installed, achieves a superior result having the foregoing features.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A combination for maintaining a reverent atmosphere in a sanctuary including:

a. a plurality of pews located in said sanctuary; said pews facing a lectern and arranged in front to back relationship; each pew having a seat, a back rest, and leg supports carrying said seat and back rest;

b. a lectern for a minister and the like;

c. a microphone at said lectern;

d. at least one amplifier connected to said microphone; and the improvement comprising:

e. resilient padding on both front and back of said back rest; said padding extending over the major portion of said front for comfort and being disposed on at least the top and bottom of the back of said back rest for compensation for changes in dimension of a cover with changes in temperature and humidity and for absorbing energy and lessening wear from people rubbing their shoes and the like on a cover disposed over the padding;

f. a fabric cover that is suceptible to changes in dimension with changes in temperature and humidity and to wear from contact with shoes and the like; said fabric cover having a longitudinal stretch induced thereinto and fastened in place over said resilient padding;

g. a plurality of speakers located in front of and facing people seated in said pews and being disposed at least one for each pew such that no individual is more than 4 feet from a speaker to thereby provide a continuum of sound with no detectable blurring because of overlap; said speakers being connected respectively with the back of a pew in front so as to provide a solid backing for reinforcement of bass tones and covered with fabric so as to be invisible such that the hearer cannot even detect from whence the sound comes; and h. each said speaker on each said pew being electrically connected to said at least one amplifier for a substantially uniform level continuum of sound for good hearing throughout said sanctuary without uncomfortable and irreverent loudness in one portion near a main speaker and without too low a sound for good hearing remote from said main speaker and without blurring from delayed sound from one main speaker mixing with sound from another main speaker at a different distance; said fabric cover and said padding absorbing acoustic energy also to reduce the overall noise level and increase the feeling of reverence and the ease of hearing in said sanctuary.

2. The combination of claim 1 wherein said back rests of said pews have attached thereto at least one book rack for each back rest, each said book rack including:

a. a rearwardly protruding side that is disposed apart from said back rest so as to provide room for insertion of a hymnal or the like therewithin; said rearwardly protruding side being covered both inside and outside with a fabric cover for reducing noise;

b. ends that are covered on at least the outside with a fabric cover for reducing noise; and c. a bottom that is covered by a fabric cover on at least its interior for reducing noise of returning hymnals and the like; said bottom being discontinuous intermediate said ends and having at least one aperture for each chamber defined therewithin for facilitating sweeping out small trash and the like without requiring vacuuming; each said book rack that is covered with fabric, including a speaker that is concealed from view by said fabric cover.

3. The combination of claim 2 wherein said covered book rack includes a holder for pencils, envelopes and the like; said holder being hollowed out at its bottom portion; said rearwardly protruding side having an aperture adjacent the hollowed out portion of said holder; said speaker being disposed intermediate said holder and said aperture in said rearwardly protruding side so as to have a solid backing, yet be covered by cloth and be hidden from view.

4. The combination of claim 3 wherein a perforate plate is interposed over said aperture in said rearwardly protruding side and said speaker so as to resist inward movement of the fabric covering the speaker; and wherein plug-in adapters are provided; at least one adjacent each of said speakers for plugging auxiliary headphones thereinto for facilitating hearing reception by the hard of hearing.

* * * * *